US005941424A

United States Patent [19]

Hildebrandt

[11] Patent Number: 5,941,424

[45] Date of Patent: Aug. 24, 1999

[54] VALVE DEVICE FOR A COMPRESSED GAS CONTAINER

[75] Inventor: Bodo Hildebrandt, Riedstadt, Germany

[73] Assignee: Wella Aktiengesellschaft, Darmstadt, Germany

[21] Appl. No.: 09/072,922

[22] Filed: May 5, 1998

[30] Foreign Application Priority Data

Jun. 18, 1997 [DE] Germany ..... 197 25 688

[51] Int. Cl.[6] ..... B65D 83/34

[52] U.S. Cl. ..... 222/148; 137/630.22; 222/402.1

[58] Field of Search ..... 137/630.22; 222/148, 222/402.1

[56] References Cited

U.S. PATENT DOCUMENTS

| | | | |
|---|---|---|---|
| 3,497,112 | 2/1970 | Samuelson | 222/148 |
| 3,520,450 | 7/1970 | Prussin et al. | 222/148 X |
| 3,675,825 | 7/1972 | Morane | 222/148 |
| 4,405,064 | 9/1983 | Stoody | 222/148 |

FOREIGN PATENT DOCUMENTS 43 08 068 A1 9/1994 Germany .

*Primary Examiner*—Gerald A. Michalsky

*Attorney, Agent, or Firm*—Michael J. Striker

[57] ABSTRACT

The valve device includes a valve body (3) having an interior chamber (12) and slidably mounted in an outer housing (18) provided with a first gas passage (19) for compressed gas and a second gas passage (20) connectable with the first gas passage (19) when the valve body is in its lower position; a hollow valve stem (4) slidably mounted in the valve body (3) and provided with a lateral opening (11) connecting the hollow valve stem (4) with the interior chamber (12) when the valve stem (4) is in its upper position relative to the valve body; a first seal (10) sealing the interior chamber (12) and the valve body (3) and a second seal (22) provided on an outer periphery of the valve body (3) acting to seal the interior chamber (12) from compressed gas when the valve body (3) is in its upper position. The second gas passage (20) is connected with the first gas passage (19) and with interior chamber (12) in the lower position of the valve body (3). The opening (11) is positioned in the valve stem (4) so that, when the stem (4) is depressed, compressed gas is supplied through the first gas passage (19) and the then connected second gas passage (20) into the interior chamber (12), so that the stem (4) is cleaned by compressed gas flowing through the lateral opening (11) from the interior chamber (12) only when the hollow stem (4) is returned to its upper position.

3 Claims, 1 Drawing Sheet

VALVE DEVICE FOR A COMPRESSED GAS CONTAINER

BACKGROUND OF THE INVENTION

The present invention relates to a valve device for a compressed gas container and, more particularly, to a valve device for a container containing a compressed gas and a product to be dispensed by action of the compressed gas.

Such valve devices are known in the art. One of such devices is disclosed for example in the German patent document DE OS 43 08 068. In this document a valve device is formed so that at the end of a product dispensing process and at the end of the actuation of the valve device, a small quantity of a driving agent is blown in the gaseous form from the head chamber of the container through a stem and a spraying head. Thereby the content of the stem and the spraying head is emptied with high pressure, and the stem and the spraying head are cleaned after the product dispensing operation. Therefore deposits in these parts are prevented.

The known valve device has a disadvantage that in the event of inexperienced use or in the event of clamping of the stem in a position located close to the upper position, an undesired gas escape from the pressurized container can occur, even a complete emptying of the container, since blowing out of the gas is performed during passing of this position by the stem. On the other hand, the known valve device has the disadvantage that additionally before the beginning of the dispensing of the product, a cleaning process is performed. This cleaning process is not needed since before, during ending of a product withdrawal, a cleaning process was already performed. The second cleaning process leads to excessive gas loss.

SUMMARY OF THE INVENTION

Accordingly, it is an object of the present invention to provide a valve device for compressed gas containers of the above mentioned general type, which avoids the disadvantages of the prior art.

More particularly, it is an object of the present invention to provide a valve device for compressed gas packings, in which an undesired gas discharge can be avoided, and only a limited cleaning process is carried out after a product discharge process.

In keeping with these objects and with others which will become apparent hereinafter, one feature of present invention resides, briefly stated, in a valve device, in which the valve housing is urged back upwardly by a spring relative to an outer housing which surrounds the valve housing, in the upper position a gas passage provided in the housing is closed by a seal of the valve housing, and between the valve housing and the outer housing a second gas passage is left which in the event of the upwardly urged valve housing communicates with the first gas passage and also communicates with a chamber through a channel between the valve housing and the seal of the valve plate.

The valve device in accordance with the present invention has the advantage that an undesired gas discharge can be avoided, and only a limited cleaning process is performed after a product discharge process. Due to the utilization of a closed chamber for receipt and discharge of a predetermined quantity of gas, a limited consumption of gas for cleaning of the stem and the spraying head is provided. Only the chamber contents is utilized for a cleaning process.

During a product discharge process, gas is supplied from the head chamber of the compressed gas container through the second gas passage into the chamber, so that it is filled with gas at high pressure. After the product withdrawal process, the gas is discharged through a lateral opening of the stem and through the stem to the environment. The stem and the spraying head located on the stem are cleaned by the gas flow. A cleaning process is performed only directly after a product discharge process. When the stem is not completely upwardly displaced, no product discharge occurs. No gas discharge corresponding to the chamber volume occurs.

In accordance with a further feature of the present invention, the second gas passage can extend parallel to the central axis of the stem, the first gas passage can extend in a radial direction from the central axis of the stem, and the seal of the inner housing in its upper position can limit the second gas passage from below and close the first passage. In this construction, in a simple way a reliable interruption of the gas flow from the head chamber to the stem is possible. The interruption is especially reliable when a two-time interruption is performed: on the one hand, between the passages and on the other hand, at the channel.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is a view showing a vertical section of a valve device in accordance with the present invention in two different positions, with a valve body, a valve housing, a stem with a lateral opening, a housing with a gas passage, and a chamber for receiving and discharging a gas volume which serves for cleaning the stem.

DESCRIPTION OF PREFERRED EMBODIMENTS

Figure 1:
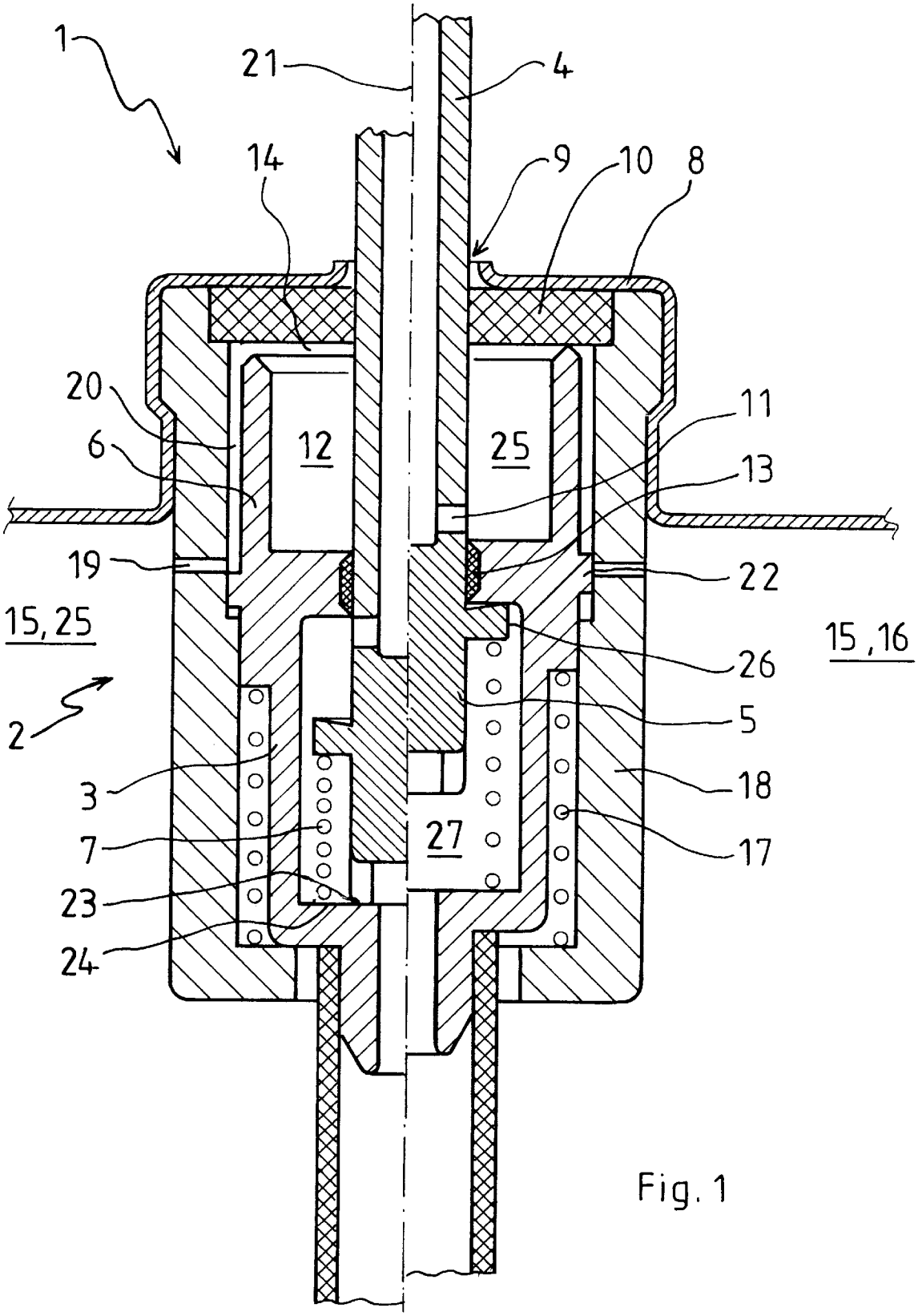

A valve device in accordance with the present invention is identified with reference numeral 2 and is used for a compressed gas container 1. The valve device 2 comprises a valve housing 6 and a hollow valve stem 4 protruding from and slidably mounted in the valve housing 6. The hollow valve stem 4 includes a lower stem body 5. The valve housing 6 opens into the compressed gas container 1. The stem body 5 is arranged on a second spring 7 which is supported in the valve housing 6 A valve plate 8 closes the compressed gas container 1 and has an opening 9. The hollow stem 4 extends through the opening 9. The valve housing 6 is sealed from the valve plate 8 by a first seal 10 which surrounds the stem 4. The stem 4 has a lateral opening 11. The opening 11 communicates with the chamber 12 when the second spring 7 is almost relaxed as shown at the right side of FIG. 1 when the stem 4 is in its upper stationary position.

An additional seal 13 is provided at a distance from the upper seal 10. The additional seal 13 closes the valve housing 6. A chamber 12 is provided between the seals 10 and 13. When the stem 4 is pressed as shown at the left side of FIG. 1 against the valve housing 6, the chamber 12 communicates through a channel 14 with a head chamber 16 of the compressed gas container 1, which contains the driving agent 15.

The valve housing 6 is urged upwardly by a first spring 17 against a bearing on an outer housing 18 which surrounds the valve housing 6. In this upper position a first gas passage 19 provided in the outer housing 18 is closed by the second seal 22 of the valve housing 6 and the housing 18. A second gas passage 20 is connected with the first gas passage 19 when the valve housing 6 is set downwardly, and is connected with the chamber 12 through the channel 14 formed between the valve housing 6 and the first seal 10 of the valve plate 8. The first gas passage 19 extends in the radial direction from the central axis 21 of the stem 4. The seal 22 of the valve housing 6 limits in its upper position the second gas passage 20 downwardly and therefore closes the first gas passage 19.

During a product dispensing process the stem 4 is held in its lower position, and its abutment 23 is pressed against a bottom 24 of the valve housing 6. In this position the gas 25 is supplied from the head chamber 16 of the compressed gas container 1 through both gas passages 19 and 20 into the chamber 12. Therefore, gas 25 fills the chamber 12 with high pressure. After the product discharge process the gas 25 with the stem 4 displaced upwardly is discharged through the lateral opening 11 of the stem 4 and through the stem 4 into the environment.

An abutment 26 limits the returned position of the stem 4 upwardly and seals there, analogously to the seal 13, a product chamber 27 relative to the chamber 12. The gas 25 from the chamber 12 cleans the stem 4. A cleaning process is performed only directly after a product withdrawal process.

It will be understood that each of the elements described above, or two or more together, may also find a useful application in other types of constructions differing from the types described above.

While the invention has been illustrated and described as embodied in a valve device for a compressed gas-containing container or pressurized container, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A valve device for a compressed gas container containing a product to be dispensed by action of a compressed gas acting as a propellant, said valve device comprising a head chamber (16) containing said compressed gas;

a valve body (3) including a valve housing (6), said valve housing being provided with an interior valve chamber (12);

an outer housing (18) in which said valve body (3) is slidably mounted so as to be movable between an upper position and a lower position in the outer housing, wherein said outer housing (18) is provided with a throughgoing first gas passage (19) communicating with said head chamber (16), and wherein said outer housing (18) and said valve body (3) are formed to provide a second gas passage (20), said second passage (20) is connected with said first gas passage (19) and with the interior valve chamber (12) when said valve body (3) is in said lower position in the outer housing, and said second gas passage (20) is arranged laterally between the valve housing (6) and the outer housing (18);

a hollow valve stem (4) including a lower stem body (5) and slidably mounted in said valve body (3) so as to be movable between an upper position and a lower position relative to the valve body, wherein said hollow valve stem is provided with a throughgoing lateral opening (11) positioned in said valve stem (4) so as to connect an interior region in the hollow valve stem (4) with the interior valve chamber (12) when said valve stem (4) is in said upper position relative to said valve body;

a valve plate (8) arranged to close the outer housing (18) and the head chamber (16) and provided with an opening (9) through which said valve stem (4) passes;

a first seal (10) surrounding said valve stem (4) and sealing said interior valve chamber (12) and said valve housing (6) from said valve plate (8);

a second seal (22) provided on an outer periphery of said valve housing (6) and spaced from said first seal (10), said second seal (22) acting to seal said interior valve chamber (12) from said head chamber (16) when said valve body (3) is in said upper position in the outer housing; and a first spring (17) arranged between said outer housing (18) and said valve body (3) to urge said valve body (3) toward said upper position in the outer housing;

wherein the first gas passage (19) and the second seal (22) are dimensioned and positioned so that in said upper position of said valve body (3) said first gas passage (19) is closed by said second seal (22); and wherein the lateral opening (11) is positioned in the valve stem (4) so that, when said stem (4) is depressed into said lower position relative to said valve body, said valve body is moved into said lower position thereof and said product is supplied through said hollow stem (4) by action of the compressed gas in the head chamber (16) and said compressed gas is supplied through said first gas passage (19) and said second gas passage (20) to said interior valve chamber (12), whereby said hollow stem (4) is cleaned by passage of said compressed gas through said lateral opening (11) from said interior valve chamber (12) when said hollow stem (4) is returned to said upper position relative to said valve body.

2. The valve device as defined in claim 1, wherein said valve stem (4) has a central axis (21), said second gas passage (20) extends parallel to said central axis (21) of said valve stem (4) and said first gas passage (19) extends in a radial direction away from said central axis (21) of said valve stem (4).

3. The valve device as defined in claim 1, wherein said second seal (22) bounds said second gas passage (20) from below and closes said first gas passage (19) when said valve housing (6) and said valve body (3) are in said upper position thereof.

* * * * *